US007524339B2

(12) United States Patent
Decker et al.

(10) Patent No.: US 7,524,339 B2
(45) Date of Patent: Apr. 28, 2009

(54) LAMP OIL COMPOSITION AND LIGHTER FLUID COMPOSITION

(75) Inventors: DayNa M. Decker, Studio City, CA (US); Constance M. Hendrickson, Irving, TX (US)

(73) Assignee: Lumetique, Inc., Los Angeles, CA (US)

( * ) Notice: Subject to any disclaimer, the term of this patent is extended or adjusted under 35 U.S.C. 154(b) by 771 days.

(21) Appl. No.: 11/003,724

(22) Filed: Dec. 2, 2004

(65) Prior Publication Data

US 2005/0115145 A1 Jun. 2, 2005

Related U.S. Application Data

(60) Provisional application No. 60/526,617, filed on Dec. 2, 2003.

(51) Int. Cl.
*C10L 1/19* (2006.01)
*C10L 1/182* (2006.01)
*F23D 3/00* (2006.01)

(52) U.S. Cl. ..... 44/388; 44/401; 44/402; 44/451; 44/452; 44/519; 431/320; 431/321

(58) Field of Classification Search ..... 44/388, 44/401, 402, 451, 452
See application file for complete search history.

(56) References Cited

U.S. PATENT DOCUMENTS

| | | | | |
|---|---|---|---|---|
| 3,175,876 | A | 3/1965 | Fredericks | |
| 3,367,758 | A | 2/1968 | Ambrose | |
| 3,819,342 | A | 6/1974 | Gunderman | |
| 3,995,397 | A | 12/1976 | Despard | |
| 4,338,376 | A | 7/1982 | Kritzler | |
| 4,364,743 | A * | 12/1982 | Erner | 44/388 |
| 4,365,971 | A | 12/1982 | Monick | |
| 4,557,687 | A | 12/1985 | Schirneker | |
| 4,568,270 | A | 2/1986 | Marcus | |
| 4,569,656 | A | 2/1986 | Shimizu | |
| 4,682,947 | A | 7/1987 | Luken | |
| 4,725,286 | A | 2/1988 | Brame | |
| 4,786,534 | A | 11/1988 | Aiken | |
| 4,805,076 | A | 2/1989 | Menter | |
| 4,855,098 | A | 8/1989 | Taylor | |
| 4,917,597 | A | 4/1990 | Henze | |
| 5,211,553 | A | 5/1993 | Menter | |

(Continued)

FOREIGN PATENT DOCUMENTS

DE 19700161 A1 7/1998

(Continued)

OTHER PUBLICATIONS www.howe.k12.ok.us; Internet printout "Lighter Fluid MSDS Demo." unknown publication date; printed out Nov. 10, 2003; 3-pages.

(Continued)

*Primary Examiner*—Ellen M. McAvoy
(74) *Attorney, Agent, or Firm*—Law Office of David Hong

(57) ABSTRACT

Lamp oil compositions including methyl palmitate, methyl stearate, myristyl alcohol, an alcohol with less than six carbons, preferably ethyl alcohol, and fragrance. Also disclosed herein are lighter fluid compositions which include methyl laurate, methyl stearate, ethyl alcohol and fragrance.

31 Claims, 1 Drawing Sheet

U.S. PATENT DOCUMENTS

| | | | | |
|---|---|---|---|---|
| 5,307,799 | A | 5/1994 | Scarnato | |
| 5,520,708 | A * | 5/1996 | Johnson et al. | 44/388 |
| 5,529,485 | A | 6/1996 | D'Ambro | |
| 5,597,300 | A | 1/1997 | Wohl | |
| 5,830,245 | A | 11/1998 | Raddon | |
| 5,840,246 | A | 11/1998 | Hammons | |
| 5,843,194 | A * | 12/1998 | Spaulding | 44/275 |
| 5,858,031 | A | 1/1999 | Perlman | |
| 5,964,905 | A | 10/1999 | Camp | |
| 5,967,769 | A | 10/1999 | Thompson | |
| 6,033,210 | A | 3/2000 | Freeman | |
| 6,063,144 | A | 5/2000 | Calzada | |
| 6,068,472 | A | 5/2000 | Freeman | |
| 6,086,644 | A | 7/2000 | Nakatsu | |
| 6,099,877 | A | 8/2000 | Schuppan | |
| 6,129,771 | A | 10/2000 | Ficke | |
| 6,159,002 | A | 12/2000 | LeJeune | |
| 6,214,295 | B1 | 4/2001 | Freeman | |
| 6,214,918 | B1 | 4/2001 | Johnson | |
| 6,241,512 | B1 | 6/2001 | Freeman | |
| 6,276,925 | B1 | 8/2001 | Varga | |
| 6,409,501 | B1 | 6/2002 | Pappas | |
| 6,419,713 | B1 | 7/2002 | Durand | |
| 6,440,184 | B2 | 8/2002 | Noda | |
| 6,454,561 | B1 | 9/2002 | Colthar | |
| 6,537,335 | B1 * | 3/2003 | Friars et al. | 44/275 |
| 6,562,294 | B1 | 5/2003 | Smith | |
| 6,667,006 | B2 | 12/2003 | Richards | |
| 6,755,877 | B2 | 6/2004 | Perlman | |
| 6,843,812 | B2 * | 1/2005 | Stephanos | 44/266 |
| 6,991,453 | B2 * | 1/2006 | Decker et al. | 431/320 |
| 7,037,348 | B2 * | 5/2006 | Freisthler | 44/389 |
| 2002/0035159 | A1 | 3/2002 | Heck | |
| 2002/0037932 | A1 | 3/2002 | Heck | |

FOREIGN PATENT DOCUMENTS

| | | |
|---|---|---|
| EP | 0874038 A2 | 10/1998 |
| EP | 1132456 B1 | 9/2001 |
| EP | 0874038 B1 | 7/2003 |
| FR | 2811676 | 1/2002 |

OTHER PUBLICATIONS www.goatindustries.co.uk; Internet printout "Using Vegetable Oil as a Diesel Fuel."; unknown publication date; printed out Oct. 16, 2003; 2-pages.

www.chemical.kao.co.jp; Internet printout "Kao's Fatty Alcohol[KALCOL]1. (2).Alcohols 2." unknown publication date, but printed out Nov. 30, 2004; 4-pages.

www.chemical.kao.co.jp; Internet printout "Kao's Fatty Alcohol[KALCOL]1. (1).Alcohols 1." unknown publication date, but printed out Nov. 30, 2004; 2-pages.

www.rohmhaas.com; Internet printout "Case studies-fatty alcohol."; unknown publication date, but printed out Nov. 30, 2004; 1-page.

www.ultrachem.com; Internet printout "Ultra Chemical, Inc.: Fatty Alcohol."; unknown publication date, but printed out Nov. 30, 2004; 1 page.

Cornell Univ.; www.pmep.cce.cornell.edu; Internet printout "fatty alcohol EPA cancellation Dec. 1991." unknown publication date, but printed out Nov. 30, 2004; 1 page.

McMurry, J.; "3.2 Straight-Chain Alkanes and Alkyl Groups."; Organic Chemistry, p. 64-66; 1988; 2nd. Ed.; Brooks/Cole Publishing Co., Pacific Grove CA.

McMurry, J.; "28.1 Fats and Oils."; Organic Chemistry, p. 1010-1012; 1988; 2nd. Ed.; Brooks/Cole Publishing Co., Pacific Grove CA.

McMurry, J.; "21.4-Conversion into Esters."; Organic Chemistry, p. 748-750; 1988; 2nd. Ed.; Brooks/Cole Publishing Co., Pacific Grove CA.

Gunstone, F.D.; www.lipid.co.uk; Internet printout. "Acids, Esters (Alkyl, Glycerol, Waxes) Alcohols and Acetates, Amides, and Nitriles." unknown publ. date; 2 pages.

www.chemicalland21.com; "Isolauryl Alcohol."; unknown publ. date; printed from Internet Feb. 4, 2005; 2 pg.

O'Lenick, A.; "A Review of Guerbet Chemistry."; unknown publ. date, printed out from www.zenitech.com Website on Feb. 4, 2005; 16 pg.

* cited by examiner

LAMP OIL COMPOSITION AND LIGHTER FLUID COMPOSITION

This application claims the benefit of U.S. Provisional Application No. 60/526,617, filed Dec. 2, 2003.

BACKGROUND OF THE INVENTION

1. Field of the Invention

This invention relates to compositions for lamp oil and lighter fluid.

2. Description of Related Art

Traditional lamp oils and lighter fluids are petroleum fuels, which inherently have many problems. These petroleum fuels containing known toxins and carcinogens can be harmful to people and the environment and can even be fatal if swallowed by small children.

These petroleum fuels have low flash points and are highly combustible. In the case of lighter fluids when they are being dispensed from a container onto burning material such as charcoal briquettes, the flame can travel up the fluid stream, seriously burning the user. Permits are needed to sell lighter fluids because of the flammability dangers. The high flammability also means that the transport of petroleum lamp oils and lighter fluids on aircraft is prohibited. Additionally, strict safety precautions need to be followed to manufacture these petroleum-based fuels and only specific manufacturers are used to manufacture them. The high combustibility also means that fragrance load therein must be low, typically less than three percent by volume, and thereby the ideal amount of fragrance often cannot be added into the fuel.

These fuels burn with soot emissions that often can cause visible black smoke and deposit. In the case of lamps oils, the wick undesirably emits black soot after being extinguished. Also, if spilled, these fuels can damage fabrics and other materials.

From the preceding descriptions, it is apparent that the devices currently being used have significant disadvantages. Thus, important aspects of the technology used in the field of invention remain amenable to useful refinement.

SUMMARY OF THE INVENTION

The present invention is directed to overcoming problems of the petroleum lamp oils and lighter fluids. The lamp oils and lighter fluids of the present invention, instead of being petroleum based, are prepared from plant-derived renewable oils and can include as the base formulation two components. The first component can be any combination of the following methyl esters of fatty acids, derived from plant oils, preferably soybean oil: methyl decanoate, methyl dodecanoate, methyl myristate, methyl palmitate, methyl stearate, and methyl oleate. The second component can be a fatty alcohol and preferably is myristyl alcohol.

In addition, a third component of an alcohol with less than six (6) carbons, including but not limited to methanol, ethanol, butanol, pentanol, and preferably ethyl alcohol, may also be added, mixed or combined with the first and second components. This alcohol with less than six (6) carbons, preferably ethyl alcohol, can be added to the base formulation of the methyl ester(s) and fatty alcohol, wherein the weight percentage of the composition of the alcohol with less than six (6) carbons, preferably ethyl alcohol, is between 5 and 15 and that of the base formulation is between 85 and 95.

A preferred lamp oil composition of the invention has as its base formulation by weight percentage: 40-60 methyl palmitate, 25-45 methyl stearate, and 10-20 myristyl alcohol, and preferably approximately 50, 35 and 15, respectively. A fragrance is preferably mixed with the base formulation or with the base formulation and the alcohol with less than six (6) carbons, preferably ethyl alcohol, and the weight percentage of the composition of the fragrance is between 1 and 10 (and preferably 5%) and that of the base formulation or with the base formulation and the alcohol with less than six (6) carbons, preferably ethyl alcohol, is between 90 and 99.

The fragrance components can range from pure essences of lavender, rose, jasmine, orange to synthetic compositions ranging from floral to citrus to herbal, including resins and animal materials such as civet or castoreum.

A preferred lighter fluid (or lighter fuel) composition of the present invention has as its base formulation by weight percentage: 40-70 methyl laurate, 10-30 methyl stearate, and 5-25 ethyl alcohol; and preferably approximately 60, 30, and 10, respectively. A fragrance is preferably mixed with the base formulation, and the weight percentage of the composition of the fragrance is between 1 and 10 (and preferably 3%) and that of the base formulation is between 90 and 99.

These compositions have many advantages over the traditional petroleum-based fuels. They are not lethal if swallowed; please note that swallowing or ingestion of these compounds is not recommended. They burn cleaner, when extinguished emitting only white smoke. They do not have an unpleasant petroleum odor, but rather smell only like vegetable oil. Due to the higher flash point, they are safer to transport. They are easier to manufacture with highly available components and with costs competitive with paraffin. They have more packaging options including plastic PET and HDPE packages. They can hold up to 15% fragrance. Additionally, they do not damage fabrics and other materials since they are water soluble.

Other objects and advantages of the present invention will become more apparent to those persons having ordinary skill in the art to which the present invention pertains from the foregoing description taken in conjunction with the accompanying drawings.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

Figure 1:
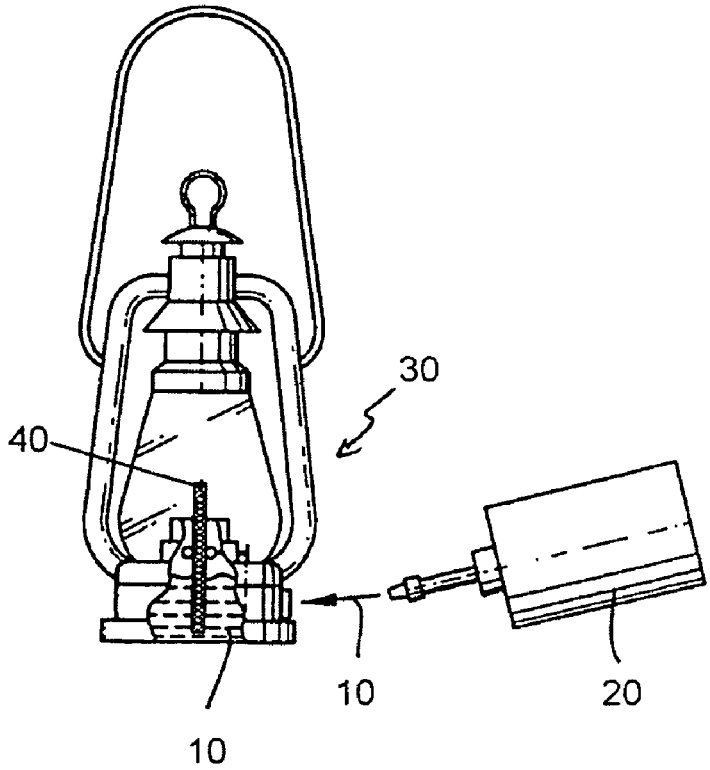
FIG. 1 is a perspective view showing a lamp oil of the present invention being poured from a storage container into an oil lamp.

Portions of these two figures are broken away for illustrative purposes.

DESCRIPTION OF THE PREFERRED EMBODIMENTS

Lamp Oil Composition

The lamp oils of the present invention are a mixture of saturated methyl esters of saturated fatty acids and a saturated fatty alcohol. The fatty alcohol is preferably a saturated fatty alcohol since an unsaturated fatty alcohol will likely turn yellow with time and will produce a rancid odor. The preferred fatty alcohols have a molecular weight between C12 and C18. The addition of the fatty alcohol to the methyl esters provides for an even, uniform good color flame and reduces smoke production. An alcohol below C12 can produce an undesirable burning odor.

A preferred lamp oil composition of the invention has as its base formulation weight percentages of 40-60 methyl palmitate, 25-45 methyl stearate, and 10-20 myristyl alcohol. The preferred percentages are approximately 50, 35 and 15, respectively. A fragrance is preferably mixed with the base formulation, and the weight percentage of the composition of the fragrance is between 1 and 10 (and preferably 5%) and that of the base formulation is between 90 and 99. The composition has a melting point of 0 to 10 degrees Centigrade, or preferably approximately 5 degrees Centigrade. The lamp oil composition has a viscosity of between 1 and 5 cps and preferably 2 cps.

In addition, an alcohol with less than six (6) carbons, such as methanol, ethanol, butanol, pentanol, and preferably ethyl alcohol, can be added to the base formulation of the methyl ester(s) and fatty alcohol, wherein the weight percentage of the composition of the ethyl alcohol is between 5 and 15 and that of the base formulation is between 85 and 95. This composition of the base formulation and the additional alcohol with less than six carbons has a melting point of 0 to 10 degrees Centigrade, or preferably approximately 5 degrees Centigrade.

While it is within the scope of the present invention to use only methyl palmitate (or another saturated methyl esters of saturated fatty acids) with no methyl stearate, the addition of the methyl stearate provides a better, more even flame. For example, 85% methyl palmitate and 15% alcohol (either fatty alcohol or an alcohol with less than six carbons or a combination of both) is an alternative though less preferred composition. Also, while the composition can be formed without an alcohol, the alcohol prevents the stearate from solidifying.

The fragrance(s) can be combinations or single notes of synthetic or pure essences: (a) floral notes, such as rose, jasmine and tuberose; (b) citrus notes, such as orange, lemon, and grapefruit; (c) woody notes, such as sandalwood, amber and cedarwood; and (d) sweet, such as vanilla, honey and chocolate. Further, the fragrances can include perfume oils of flower extracts (lavender, roses, jasmine, neroli), stalks and leaves (geranium, patchouli, petitgrain), fruits (anise, coriander, costus, iris, calmus), woods (sandalwood, guajak wood, zedem wood, rosewood), herbs and grasses (tarragon, lemon grass, salvia, thyme), needles and twigs (spruce, fir, pine, dwarf pine), and resins and balsams (galbanum, elemi, benzoin, myrrh, olibanum, opopomax). They further can include raw animal materials such as moschus, civet, and castoreum. Ambroxan, eugenol, isoeugenol, citronellal, hydroxycitronellal, geranoil, citronellol, geranyl acetate, citrate, ionone, and methylionone are usable as synthetic or semi-synthetic perfume oils therein.

Dyes can also be used in the lamp oil. Usually, PET or glass bottles are used for packaging and the oil can be seen through them. For instance, if a lavender fragrance is used, a purple dye to differentiate the look of each bottle with the fragrance can be included. Most petroleum lamp oils are sold in different colors due to the look of traditional oil lamps being made out of glass. The alternative colors are desirable to add to the look of oil lamps. Since the present oil can be sold with traditional oil lamps, colored oils can be used. The concentration of the dye can vary between 0.001 to 0.1% by weight and may be in powder or liquid form before being added.

The methyl stearate and the methyl laurate can be purchased premixed from a supplier in the desired ratio, and then mixed with the alcohol and with the fragrance (and dye) to form the lamp oil, as shown by reference numeral 10 in FIG. 1. Lamp oil 10 is packaged in a container 20 of the desired size, shape and material and then sold to the consumer. The consumer pours or otherwise dispenses the desired amount of the lamp oil 10 from the container 20 into the oil lamp 30, having a wick 40. Portions of the oil lamp 30 are broken away in FIG. 1 to show the lamp oil 10 therein.

The container 20 can have generally any size, for example, 8, 12, 16 or 32 ounces or one gallon. The container 20 can be generally any container material such as glass, PET plastic, HDPE, metal, because the lamp oil 10 is not highly flammable. In fact to light it, a wick 40 or a very thin layer of the lamp oil 10 needs to be used. If a lit match were tossed into a beaker of the lamp oil, it would not ignite. This makes the oil safe to transport. In fact, unlike petroleum or alcohol based fuels, it can even be safely transported on aircraft.

Lighter Fluid Composition

For the lighter fluid composition the base formulation preferably includes by weight percentage: 40-70 methyl laurate, 10-30 methyl stearate, and 5-25 ethyl alcohol. And the preferred weight percentages of the methyl laurate, methyl stearate and ethyl alcohol are approximately 60, 30, and 10, respectively. A fragrance is preferably mixed with the base formulation. The weight percentage of the composition of the fragrance is between one and ten and that of the base formulation is between 90 and 99. The preferred weight percentage of the composition of the fragrance is approximately three. The fragrance can be applewood, mesquite, cilantro, herbal and/or citrus blends. Dyes can be added to the lighter fluid similar to the lamp oil as discussed above.

The amount of alcohol is selected to be low enough so that flammability or flash point does not increase. The flashpoint of the above-discussed composition is between 180 and 220 degrees Fahrenheit, and a flashpoint of a preferred composition is approximately 200 degrees Fahrenheit. On the other hand, the amount of the alcohol is selected to be high enough to provide a low viscosity. The viscosity of the composition is between one and five centipoise (cps), and the preferred viscosity is approximately two cps.

Figure 2:
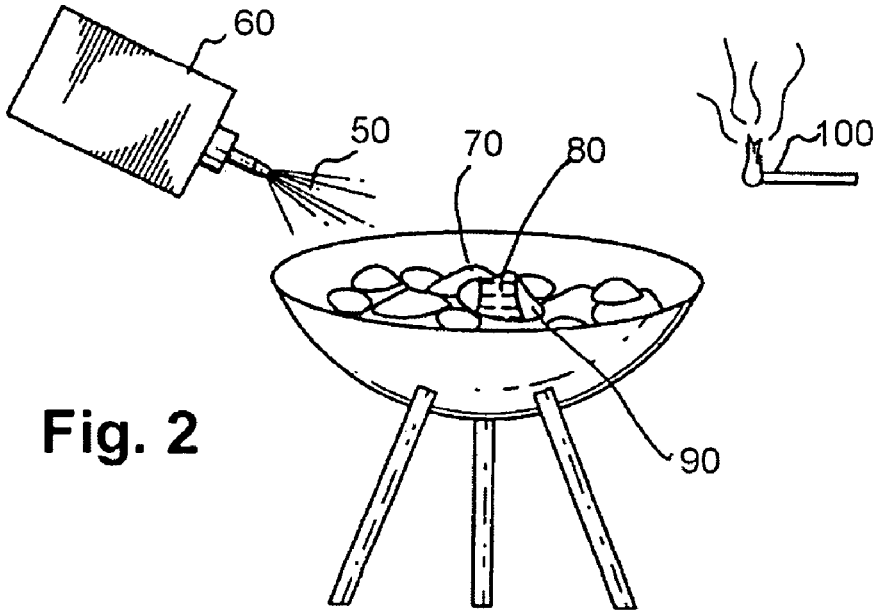
FIG. 2 is a perspective view showing a lighter fluid of the present invention being sprayed or otherwise dispensed from a storage container onto charcoal briquettes or other similar fuel.

Referring to FIG. 2, a lighter fluid 50 of the present invention is shown being dispensed from a container 60 onto briquettes or other fuel material 70. The container 60 can be made of generally any material including plastics and is preferably quart size. When the lighter fluid 50 is poured or otherwise dispensed on the briquettes 70, it is desirable, pursuant to the present invention, that the fluid not only soak into the center area 80 of the briquettes but that it also form a thin layer, coating or film 90 on the outside surface of the briquettes. This coating allows the briquette to ignite better and more consistently when a match 100 for example, is tossed on it, than if all of the fluid were soaked into the center.

One way of "thickening" the fluid to make it more like a gel is to add a thickener to the methyl ester. This may result though in flammability problems, making it more difficult to light it. Thus, a preferred solution is to add methyl stearate (18 Carbon) to the methyl laurate (12 Carbon). By going up the carbon chain, the fluid becomes a little more viscous and adheres better to the surface of the briquettes 70.

From the foregoing detailed description, it will be evident that there are a number of changes, adaptations and modifications of the present invention that come within the province of those skilled in the art. The scope of the invention includes any combination of the elements or components from the different species, compositions or embodiments disclosed herein, as well as subassemblies, assemblies, and methods thereof. However, it is intended that all such variations not departing from the spirit of the invention be considered as within the scope thereof.

A lamp oil composition, comprising: a base formulation including by weight %: 40-60 methyl palmitate; 25-45 methyl stearate; and 10-20 myristyl alcohol; said composition further comprising an alcohol with less than six carbons, wherein the weight percentage of the composition of the alcohol with less than six carbons is between 5 and 15 and that of the base formulation is between 85 and 95.

The alcohol with less than six carbons can be ethyl alcohol. The composition of the base formulation and the alcohol with less than six carbons has a melting point of 0 to 10 degrees Centigrade; the composition has a melting point of approximately degrees Centigrade.

The composition may further comprise a fragrance mixed with the base formulation and the alcohol with less than six carbons. The fragrance can be selected from the group of combinations or single notes of synthetic or pure essences consisting of: floral notes, citrus notes, woody notes, and sweet notes.

The weight percentage of the composition of the fragrance is between 1 and 10 and that of the base formulation and the alcohol with less than six carbons is between 90 and 99; also, the weight percentage of the composition of the fragrance can be approximately 5.

The weight percentages of the methyl palmitate, methyl stearate and myristyl alcohol of the base formulation are approximately 50, 35 and 15, respectively; the composition further comprises a dye mixed with the base formulation and the alcohol with less than six carbons; the viscosity of the composition is between 1 and 5 centipoises.

A lighter fluid composition, comprising: a base formulation including by weight percentage: 40-70 methyl laurate; 10-30 methyl stearate; and 5-25 ethyl alcohol; the weight percentages of the methyl laurate, methyl stearate and ethyl alcohol further can be approximately 60, 30, and 10, respectively. The flashpoint of the composition is between 180 and 220 degrees Fahrenheit; the flashpoint of the composition can also be approximately 200 degrees Fahrenheit. The viscosity of the composition is between 1 and 5 centipoise (cps). Also, the viscosity of the composition is approximately 2 cps.

This composition can further comprise a fragrance mixed with the base formulation; this fragrance can be selected from the group of applewood, mesquite, cilantro, herbal, and citrus blends; the weight percentage of the composition of the fragrance is between 1 and 10 and that of the base formulation is between 90 and 99; also, the weight percentage of the composition of the fragrance can be approximately 3.

An assembly comprising: a lighter fluid dispensing container; and a quantity of lighter fluid disposed in the container, the lighter fluid including a mixture of methyl laurate, methyl stearate, ethyl alcohol, and fragrance; this quantity can be a quart or a plastic container.

Lamp Oil Composition with Ethyl Alcohol

In another preferred embodiment of the lamp oil composition of the invention, an alcohol with less than six carbons, such as methanol, ethanol (ethyl alcohol), butanol, and penthanol, can be added, mixed, or combined with the base formulation as described above. See base formulation weight percentages of 40-60 methyl palmitate, 25-45 methyl stearate, and 10-20 myristyl alcohol; the preferred percentages are approximately 50, 35 and 15, respectively.

The ethyl alcohol can be added to the base formulation of the methyl ester(s) and fatty alcohol, wherein the weight percentage of the composition of the ethyl alcohol is between 5 and 15 and that of the base formulation is between 85 and 95.

In addition, the ethyl alcohol can be added to the base formulation of the methyl ester(s) and fatty alcohol, wherein the weight percentage of the composition of the ethyl alcohol is between 1 and 15 and that of the base formulation is between 85 and 99.

Another advantage of adding ethyl alcohol to the lamp oil composition is to prevent the lamp oil wick from changing color over time, prevents the accumulation of waxing material on the wick, and improves the wicking action.

Similar to the embodiments above, fragrances and dyes can be added to the base formulation and alcohol with less than six carbons, preferably ethyl alcohol. A fragrance is preferably mixed with the base formulation and the ethyl alcohol, and the weight percentage of the composition of the fragrance is between 1 and 10 (and preferably 5%) and that of the base formulation and the ethyl alcohol is between 90 and 99. This composition has a melting point of 0 to 10 degrees Centigrade, or preferably approximately 5 degrees Centigrade. The lamp oil composition has a viscosity of between 1 and 5 cps and preferably 2 cps.

While the invention as described in connection with its preferred embodiments, it will be understood that it is not intended to limit the invention to those embodiments. On the contrary, it is intended to cover all alternatives, modifications, and equivalents as may be included within the spirit and scope of the invention.

We claim:

1. A lamp oil composition, comprising:

a base formulation including by weight %:

40-60 methyl palmitate;

25-45 methyl stearate; and 10-20 myristyl alcohol;

said composition further comprising an alcohol with less than six carbons, wherein the weight percentage of the composition of the alcohol with less than six carbons is between 5 and 15 and that of the base formulation is between 85 and 95.

2. The composition of claim 1 wherein the alcohol with less than six carbons is ethyl alcohol.

3. The composition of claim 2 wherein the composition has a melting point of 0 to 10 degrees Centigrade.

4. The composition of claim 2 wherein the composition has a melting point of approximately 5 degrees Centigrade.

5. The composition of claim 1 further comprising a fragrance mixed with the base formulation and the alcohol with less than six carbons.

6. The composition of claim 5 wherein the fragrance is selected from the group of combinations or single notes of synthetic or pure essences consisting of: floral notes, citrus notes, woody notes, and sweet notes.

7. The composition of claim 5 wherein the weight percentage of the composition of the fragrance is between 1 and 10 and that of the base formulation and the alcohol with less than six carbons is between 90 and 99.

8. The composition of claim 5 wherein the weight percentage of the composition of the fragrance is approximately 5.

9. The composition of claim 1 wherein the weight percentages of the methyl palmitate, methyl stearate and myristyl alcohol of the base formulation are approximately 50, 35 and 15, respectively.

10. The composition of claim 1 further comprising a dye mixed with the base formulation and the alcohol with less than six carbons.

11. The composition of claim 2 wherein the viscosity of the composition is between 1 and 5 centipoises.

12. An assembly, comprising:

a lamp having an oil chamber and a wick communicating with the chamber; and a quantity of lamp oil in the oil chamber, the lamp oil including a mixture of methyl palmitate, methyl stearate, myristyl alcohol, an alcohol with less than six carbons and fragrance.

13. The assembly of claim 12 wherein the quantity of lamp oil in the chamber is approximately 1-32 ounces.

14. A lighter fluid composition, comprising:

a base formulation including by weight percentage:

40-70 methyl laurate;

10-30 methyl stearate; and 5-25 ethyl alcohol.

15. The composition of claim 14 wherein the weight percentages of the methyl laurate, methyl stearate and ethyl alcohol are approximately 60, 30, and 10, respectively.

16. The composition of claim 14 wherein the flashpoint of the composition is between 180 and 220 degrees Fahrenheit.

17. The composition of claim 14 wherein the flashpoint of the composition is approximately 200 degrees Fahrenheit.

18. The composition of claim 14 wherein the viscosity of the composition is between 1 and 5 centipoise (cps).

19. The composition of claim 14 wherein the viscosity of the composition is approximately 2 cps.

20. The composition of claim 14 further comprising a fragrance mixed with the base formulation.

21. The composition of claim 20 wherein the fragrance is selected from the group of applewood, mesquite, cilantro, herbal, and citrus blends.

22. The composition of claim 20 wherein the weight percentage of the composition of the fragrance is between 1 and 10 and that of the base formulation is between 90 and 99.

23. The composition of claim 20 wherein the weight percentage of the composition of the fragrance is approximately 3.

24. An assembly comprising:

a lighter fluid dispensing container; and a quantity of lighter fluid disposed in the container, the lighter fluid including a mixture of methyl laurate, methyl stearate, ethyl alcohol, and fragrance.

25. The assembly of claim 24 wherein the quantity is a quart.

26. The assembly of claim 24 wherein the container is a plastic container.

27. A composition made by combining:

a base formulation including by weight %:

40-60 methyl palmitate;

25-45 methyl stearate; and 10-20 myristyl alcohol;

said composition further comprising ethyl alcohol, wherein the weight percentage of the composition of the ethyl alcohol is between 5 and 15 and that of the base formulation is between 85 and 95.

28. The composition of claim 27 further comprising a fragrance mixed with the base formulation and the ethyl alcohol.

29. The composition of claim 28 wherein the weight percentage of the composition of the fragrance is between 1 and 10 and that of the base formulation and the ethyl alcohol is between 90 and 99.

30. The composition of claim 27 wherein the weight percentages of the methyl palmitate, methyl stearate and myristyl alcohol of the base formulation are approximately 50, 35 and 15, respectively.

31. The composition of claim 27 further comprising a dye mixed with the base formulation and the ethyl alcohol.

* * * * *